US008696233B2

(12) United States Patent
Wijnant

(10) Patent No.: US 8,696,233 B2
(45) Date of Patent: Apr. 15, 2014

(54) ROAD WITH SOUND DIFFRACTORS

(75) Inventor: Ysbrand Hans Wijnant, Enschede (NL)

(73) Assignee: 4Silence B.V., GE Oldenzaal (NE)

( * ) Notice: Subject to any disclaimer, the term of this patent is extended or adjusted under 35 U.S.C. 154(b) by 0 days.

(21) Appl. No.: 13/503,601

(22) PCT Filed: Oct. 22, 2010

(86) PCT No.: PCT/NL2010/050706

§ 371 (c)(1),
(2), (4) Date: Jun. 29, 2012

(87) PCT Pub. No.: WO2011/049454

PCT Pub. Date: Apr. 28, 2011

(65) Prior Publication Data

US 2012/0263524 A1 Oct. 18, 2012

(30) Foreign Application Priority Data

Oct. 22, 2009 (NL) ..... 2003697

(51) Int. Cl.
*E01C 11/00* (2006.01)

(52) U.S. Cl.
USPC ..... 404/17

(58) Field of Classification Search
USPC ..... 404/6–9, 12, 17–22, 24, 27–29, 32, 404/34–36, 39, 42–45, 75, 92–94, 99; 94/22; 181/210, 286, 288, 292
See application file for complete search history.

(56) References Cited

U.S. PATENT DOCUMENTS 3,057,274 A * 10/1962 Janowitz ..... 404/74
3,529,517 A * 9/1970 Christensen et al. ..... 404/14
3,605,579 A * 9/1971 Heltzel ..... 404/93
4,015,682 A * 4/1977 Keller ..... 181/210
4,158,401 A * 6/1979 Matsumoto et al. ..... 181/210
4,244,439 A 1/1981 Wested
5,959,265 A 9/1999 Van Ligten
6,253,872 B1 * 7/2001 Neumann ..... 181/210
7,963,362 B2 * 6/2011 Lidoine ..... 181/214
8,132,644 B2 * 3/2012 Van Veen ..... 181/210

FOREIGN PATENT DOCUMENTS

WO WO 95/21964 A1 8/1995
WO WO 97/45592 A1 12/1997

OTHER PUBLICATIONS

International Preliminary Report on Patentability and Written Opinion dated Apr. 24, 2012 for International Application No. PCT/NL2010/050706, filed Oct. 22, 2010.

* cited by examiner

*Primary Examiner* — Raymond W Addie
(74) *Attorney, Agent, or Firm* — Knobbe Martens Olson & Bear LLP

(57) ABSTRACT

The invention relates to a road with at least one traffic lane for motorized vehicular traffic, to which road are added sound attenuating means which limit, at least for determined frequency ranges, the lateral emission of sound caused by traffic travelling over the road, and has the feature that a pattern of resonators placed in distributed manner is arranged at least locally over a chosen length along the traffic lane, which resonators each comprise an acoustically hard, non-absorbing resonance space placed under the surface and debouching in an orifice situated at least roughly at a level of the surface of a roadside edge adjacent to the traffic lane, which resonators have resonance frequencies lying in the range of the frequencies of the sound for attenuating, in particular frequencies around about 1 kHz.

20 Claims, 13 Drawing Sheets

ROAD WITH SOUND DIFFRACTORS

CROSS REFERENCE TO RELATED APPLICATIONS

This application is the U.S. National Phase under 35 U.S.C. §371 of International Application No. PCT/NL2010/050706 entitled ROAD WITH SOUND DIFFRACTORS, filed Oct. 22, 2010, designating the U.S. and published in English on Apr. 28, 2011 as WO 2011/049454, which claims priority under 35 U.S.C. §119(a)-(d) to Netherlands Patent Application No. NL2003697, filed Oct. 22, 2009.

BACKGROUND

The invention relates to a road with at least one traffic lane for motorized vehicular traffic, to which road are added sound attenuating means which limit, at least for determined frequency ranges, the lateral emission of sound caused by traffic travelling over the road.

Such a road is known. A known road comprises sound attenuating means in the form of a noise-reducing screen or a noise barrier. Behind a noise-reducing screen there is a "shadow side", whereby traffic noise, in particular sound from rolling tyres, is attenuated. Noise-reducing screens are reasonably effective, particularly in the case of houses in the vicinity of such a road, in at least limiting the worst noise nuisance.

The sound frequencies are concentrated in a spectral range around about 1 kHz, in particular the frequency band of about 700 to 1,300 Hz, as shown in inter alia "Euronoise Naples 2003, paper ID 498 'The Multi-Coincidence Peak around 1000 Hz in Tyre/Road noise spectra', Ulf Sandberg".

Noise-reducing screens or noise barriers are expensive provisions. They further have an adverse effect on the landscape and often deprive residents of an unobstructed view. They moreover have the drawback that their effectiveness is limited in the case of specific wind directions.

It is further known that particular types of road surface, for instance the very open asphalt concrete, or ZOAB, can bring about a substantial reduction in the sound caused by tyres. A sound reduction from several dB up to about 7 dB can hereby be realized. It is nevertheless desirable, particularly in view of the greatly increased traffic intensity, to realize a further additional sound reduction.

SUMMARY

For the above stated reasons it is an object of the invention to embody a road of the described type such that the sound attenuating means are considerably cheaper, can be placed considerably more easily than noise-reducing screens, do not adversely affect the landscape, do not obstruct a view and are substantially independent of the prevailing wind.

With a view hereto the invention provides a road of the stated type which has the feature that a pattern of resonators placed in distributed manner is arranged at least locally over a chosen length along the traffic lane, which resonators each comprise a resonance space placed under the surface and debouching in an orifice situated at least roughly at a level of the surface of a roadside edge adjacent to the traffic lane, which resonators have resonance frequencies lying in the range of the frequencies of the sound for attenuating, in particular frequencies around about 1 kHz; and which resonators are each embodied as a cavity, the walls of which are acoustically substantially non-absorbing and which is free of acoustically absorbing material;

such that diffraction of said sound occurs in a direction differing from the lateral direction.

It is important to note that the realized attenuation occurs almost only in lateral direction and is achieved not through absorption but through diffraction.

The effectiveness of the noise reduction according to the invention increases as the overall active surface area of the orifices increases. In a given structure it is possible to refer to the porosity, i.e. the ratio of the total orifice surface area of the orifices and the total relevant surface area of the structure. The theoretically ideal value would amount to 100%, but it will be apparent that the practically feasible value is also determined by mechanical considerations, for instance the requirement to embody the resonators such that they are not damaged by traffic travelling thereover.

Attention is drawn to U.S. Pat. No. 5,959,265. Known from this publication is a sound-absorbing structure consisting of a pattern of ¼λ sound-absorbing elements, particularly for use in vehicles.

Although the physical mechanisms forming the basis of this known art are related to those according to the invention, at least where the use of resonators is concerned, attention is drawn to the fact that the sound attenuating means according to the invention are not adapted to cause sound absorption but to effectively deflect the traffic noise incident upon the orifices.

When orifices of the resonators are exposed to traffic noise, they will begin to display one or more resonances in accordance with their design. As a result the air at the location of the orifice will be caused to resonate at the relevant resonance frequency or resonance frequencies. It is assumed here that the sound for treating has substantial frequency components at the resonance frequency or frequencies. The relevant sound is emitted in substantially vertical direction and thus has a barrier effect on the sound propagation in lateral direction. Created as it were is a small virtual sound barrier of air. This has the surprising effect that the sound waves parallel to the ground are attenuated very substantially in the direction away from the roadway.

At an angle relative to the horizontal of up to about 20° to 30° a sound reduction takes place in that the sound is effectively deflected upward. This effect takes place in a direction perpendicularly of the roadway. Said barrier effect could to some extent be compared to the shadow effect of a noise-reducing screen or a noise barrier. The closer the resonators are disposed to the source, the greater is the angle to be realized. It must therefore be understood that, with a correct dimensioning of the sound attenuating means according to the invention, an attenuation of the sound can be realized in the chosen frequency bands such that particularly residents, for whom the horizontal angle will amount in practice to no more than a few degrees, will perceive that the traffic noise is attenuated by an amount in the order of several dB or even more. It is possible to envisage an amount in the order of 3-5 dB overall SPL. This means that the overall sound pressure level will be reduced by this amount. At specific frequencies, for instance in the important frequency band of 700-800 Hz, the attenuation can be substantially greater. Certainly due to the fact that the provisions of the invention are situated in or at least close to the ground and in reality therefore invisible, the effect of the invention could be qualified as very good.

In a specific embodiment the road according to the invention can have the special feature that the resonators are based on depth resonance, and are particularly embodied as ¼λ elements as well as ¾λ elements.

It is noted in the case of this specific embodiment that the use is known of noise-reducing screens on the upper edge of which resonators/absorbers are arranged. This is however an essentially different solution from that according to the invention, wherein the resonators acting as diffusing elements are arranged, preferably buried, as close as possible to the roadway, in particular in the roadside shoulder thereof.

In yet another embodiment the road according to the invention has the feature that each of the resonators is embodied as Helmholtz resonator with a cavity and a tube connecting the cavity to an orifice.

Most traffic noise has strong components in the range of about 500 Hz to 3 kHz. The frequencies for passenger cars are somewhat higher than for trucks. In respect of these known frequencies the road according to the invention preferably has the feature that the resonance frequencies lie in the range of about 500 Hz to 3 kHz.

In a practical embodiment the road has the special feature that the resonators are embodied as bins with upright side walls or a peripheral upright wall.

The form of the bins is found in practice not to be of essential importance. Good results can be achieved with different forms of bin. The cross-sections can be chosen at random within determined limits. A usual rectangular cross-section with a base having two upright walls is for instance very suitable, although a downward tapering form with two obliquely disposed side walls together bounding a general V-shape can also be applied. The resonators can further have an at least more or less round, substantially cylindrical form, a more or less parallelepiped-like form or any other suitable form. Such resonators are per se known and in general do not therefore form part of the present invention.

A Helmholtz resonator comprises a cavity defining an air spring and a tube connecting thereto and defining an acoustic mass. Such a per se known resonator has a design-dependent resonance frequency.

According to a specific aspect of the invention, the road has the special feature that the bins form part of a construction manufactured from optionally reinforced concrete and/or optionally reinforced plastic, for instance glass fibre-reinforced polyester.

The material of the bins must have a strength sufficient to be able to withstand the weight force of traffic travelling thereover, and must moreover be ageing-resistant. Concrete is an inexpensive, highly reliable material which is easy to process and has proven to be a generally excellent choice in road construction. Many roadside lining blocks are thus manufactured from concrete.

It is important to note that a structure with Helmholtz resonators cannot be manufactured in one concrete casting or plastic moulding operation. This is because there is an undercut form, and it will therefore be necessary to manufacture and mutually couple two separate elements in appropriate manner. A concrete slab with a number of cavities can thus be manufactured, which slab is subsequently covered with a slab likewise manufactured from concrete which has a number of through-holes fulfilling the function of the tube of the Helmholtz resonator. The desired different resonance frequencies can be realized by for instance opting to make all the cavities in the lower concrete slab the same and choosing the diameter of the through-holes of the cover slab as desired.

In a preferred embodiment the road comprises a pattern of slot-like recesses which extend in longitudinal direction and optionally in mutually parallel zones and which each form a resonator, the slots being bounded by two upright walls, which walls are connected to each other locally by transverse partitions.

The embodiment in which the bins form part of a concrete or plastic construction can advantageously have the special feature that a construction comprises a number of resonators.

In a preferred embodiment this road has the feature that at least a number of resonators have mutually differing resonances. A strong acoustically attenuating effect can hereby be realized over a wide frequency band.

In order to prevent the resonators filling with water or dirt, the road according to the invention can advantageously have the special feature that discharge openings for water and dirt connect to the underside of the resonators.

It is reiterated that the pattern of the resonators according to the invention provides for a diffraction of the sound. According to U.S. Pat. No. 5,959,265 patterns of resonators can also be applied for the purpose of absorbing sound, although it is then important that the porosity, i.e. the overall orifice surface area divided by the overall surface area, is quite small. According to the invention however, it is essential that the acoustically active surface area, so the total surface area of the orifices, is as large as possible. It is thus possible with specific patterns or arrangements of resonators to achieve that the porosity amounts to at least 10%, preferably more than 50% or even 70 to 80%. The porosity is not of decisive importance per se, provided the stated criterion is met. The width of the resonators in the width of the overall package of resonators, so the complete pattern, are important. Recommended are slots with a width in the order of magnitude of 2 cm and the largest possible surface are of the pattern per meter of roadway length.

A wide-band diffraction can be realized with ¼λ resonators of differing depth. Such a structure can be realized very easily in concrete.

A great additional advantage of the invention is that the diffractors can be placed considerably closer to the source, i.e. the passing traffic, than a noise-reducing screen.

It will be apparent that, depending on the building situation around a traffic route, patterns of resonators could also be placed on both roadsides of the roadway. Patterns of resonators could also be placed in the central reservation.

NL-A-78 11154 relates to a sound-absorbing construction. This is essentially different from the construction according to the invention, which is not based on sound absorption but on sound diffraction. According to the invention a diffraction of the incident sound wave takes place by applying resonating elements which display hardly any absorption, and preferably not at all. Essential according to the present invention is therefore that the degree of absorption of the resonators is negligible. NL-A-78 11154 deals with two embodiments, wherein the material of the resonating elements take an absorbent form, or absorbent material is placed in the cavities in the case where the resonators are manufactured from substantially non-absorbing and therefore acoustically hard material. According to the present invention the material from which the resonators are manufactured is non-absorbing, nor is any absorbent material placed in the resonating cavities.

In respect of the invention this also has implications with regard to the chosen form and configuration. The arrangement of resonators for the purpose of sound absorption requires a certain porosity, i.e. the ratio of the total orifice surface area of the resonators and the total associated surface area. This porosity must be very low when a surface with resonators must absorb sound. Conversely, the highest possible porosity is advantageous for sound diffraction as according to the present invention. With the low porosity at which absorption occurs the diffraction is very low. With the high porosity associated with diffraction the absorption is very low.

Further discussed in NL-A-78 11154 is a periodic structure of resonators. A plurality of resonators must therefore be present. According to the present invention this is not essential. A single resonator already provides for diffraction. The acoustic coupling between the resonators necessary for the construction according to NL-A-78 11154 is not necessary here for diffraction as intended by the invention.

NL-A-78 11154 refers to the sound attenuation to be achieved per meter of placed resonators. This cannot be stated in the context of diffraction. According to the invention there is essentially no sound attenuation, but a deflection upward which provides for a reduction in the intensity of noise in the area away from the resonators as seen from the road surface.

NL-A-78 11154 further states that an essential opposite phase should occur in adjacent slots. This is not the case with diffraction according to the invention.

U.S. Pat. No. 5,959,265 refers to a ¼λ sound absorber. As discussed above, the present invention does not relate thereto. This American patent does not therefore provide the diffraction effect which is intended and can be realized by the present invention, since the porosity is much too low for this purpose. In addition, according to the art of this American patent the relevant structure cannot be embodied as longitudinal slots, since then the overall porosity here becomes too high.

For the sake of completeness references also made to WO-A-95/21964 and WO-A-97/45592. These two references also relate to absorption and make no reference whatever to diffraction as according to the present invention.

BRIEF DESCRIPTION OF THE DRAWINGS

The invention will now be elucidated on the basis of the accompanying drawings. Herein.

DETAILED DESCRIPTION

Figure 1:
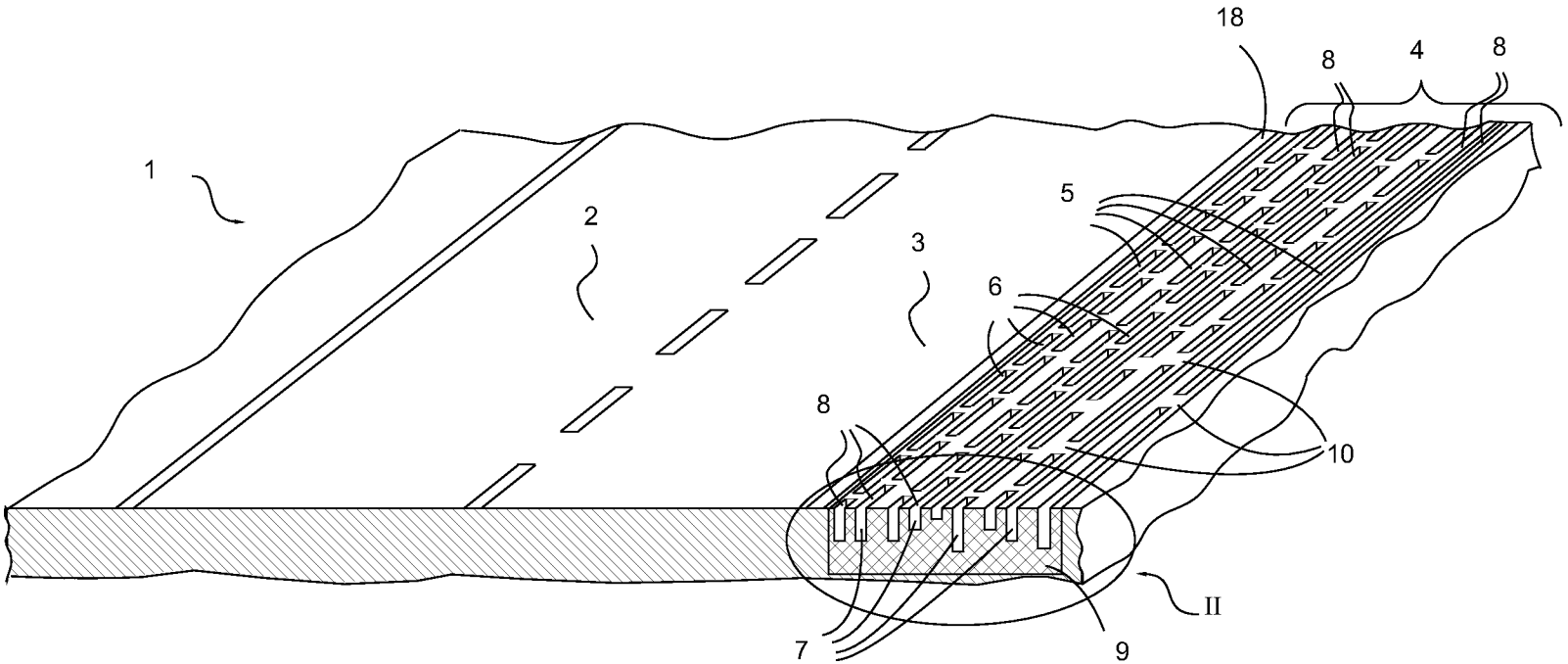
FIG. 1 is a partially cut-away perspective view of a road with a pattern of resonators according to the invention.

FIG. 1 shows a road 1 with two traffic lanes 2, 3 for motorized vehicular traffic. A roadside shoulder 4 is added to road 1.

Road 1 has the special feature that a pattern 5 of resonators, all designated with 6, is placed at least locally over a chosen length along traffic lane 3, which resonators comprise a resonance space, all designated with 7, which in this embodiment is placed underground and debouches in an orifice, all designated with 8, which in this embodiment is elongate, the orifices 8 being at least roughly coplanar with, and so at the level of, the surface of shoulder 4. The orifices can thus be situated at the level of the roadway, but can also be arranged in separate elements, manufactured for instance from concrete, having a slightly inclining position relative to the road surface. The plane of the orifice thus has a certain angle to the road surface. Resonators 6 have resonance frequencies in the range of the frequencies of the sound to be attenuated, in particular in the range of about 500 Hz to 3 kHz. The total surface area of orifices 8 amounts to at least 10%, for instance about 60%, of the total surface area of pattern 5.

In the embodiment of FIG. 1 the resonators are based on depth resonance and are embodied particularly as ¼λ elements or ¾λ elements.

Resonators 6 are embodied as slot-like recesses or cut-out portions in concrete constructions 9 which are buried in the ground of shoulder 4 at the smallest possible distance from traffic lane 3. The technique applicable for this purpose is per se known in the road construction industry. Many roads have adjacently of the traffic lanes so-called roadside shoulder linings which consist of patterns of optionally mutually coupled, profiled concrete blocks.

A construction 9 can be manufactured easily from concrete using a suitable mould. Not drawn is that the concrete could if necessary also be provided with reinforcing bars. These longitudinal bars could also be mutually connected by transverse reinforcing bars.

It will be apparent from FIG. 1 that the structure according to the invention is not represented on a realistic scale relative to traffic lanes 2, 3. For the depth of resonators 6 it is for instance possible to envisage a value in the order of 15 cm, corresponding to a lowest resonance frequency of about 500 Hz, and a value in the order of 4 cm corresponding to the resonance frequency of about 2 kHz. The width of a traffic lane 2, 3 amounts to several meters.

It is noted that a ¼λ resonator also has, in addition to a resonance frequency corresponding to a quarter of the λ, a resonance at a frequency corresponding to ¾λ. The resonator with the lowest resonance frequency of 500 Hz can therefore also resonate at 1500 Hz. Attention is further drawn to the fact that a wide frequency spectrum can be covered by using a plurality of resonators.

It will be apparent that constructions 9 must have a strength sufficient to withstand all forces which can be exited thereon by traffic travelling thereover, in particular goods traffic. It is therefore important that the walls which define slots are connected to each other locally by reinforcing transverse partitions, which are designated with 10.

Figure 3:
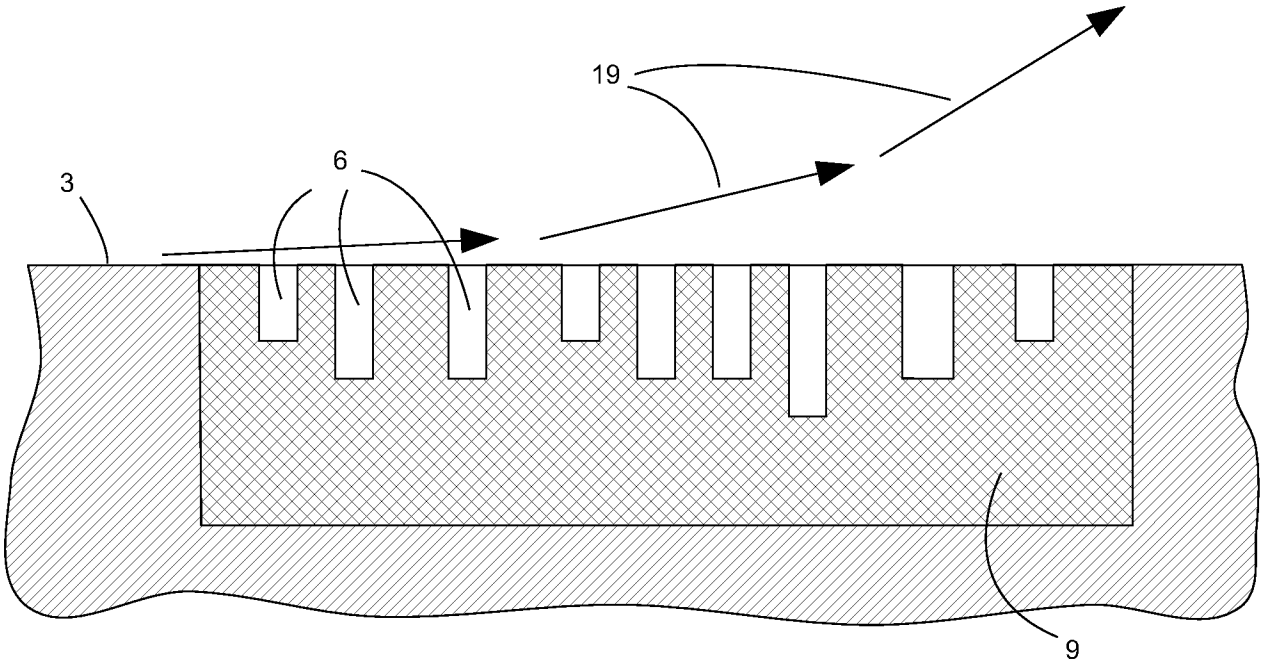
FIG. 3 shows a cross-section on larger scale of another embodiment.

FIG. 3 shows on larger scale a variant in which the basic structure corresponds to that according to FIG. 1, while the dimensioning is different.

Indicated by arrows in FIG. 3 is that, due to the action of the resonators, the tyre noise coming from traffic lane 3 undergoes a certain deflection.

Figure 4:
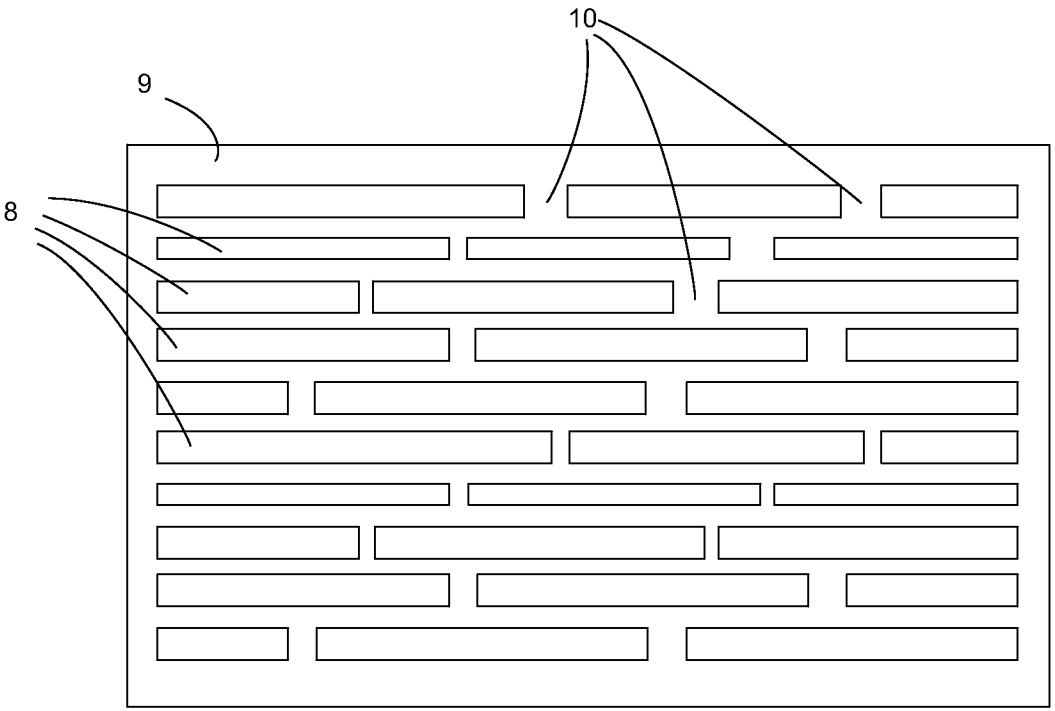
FIG. 4 is a top view of a random pattern of elongate rectangular resonators.

FIG. 4 shows a top view of a concrete construction 9 with yet another arrangement of the resonators.

Figure 5:
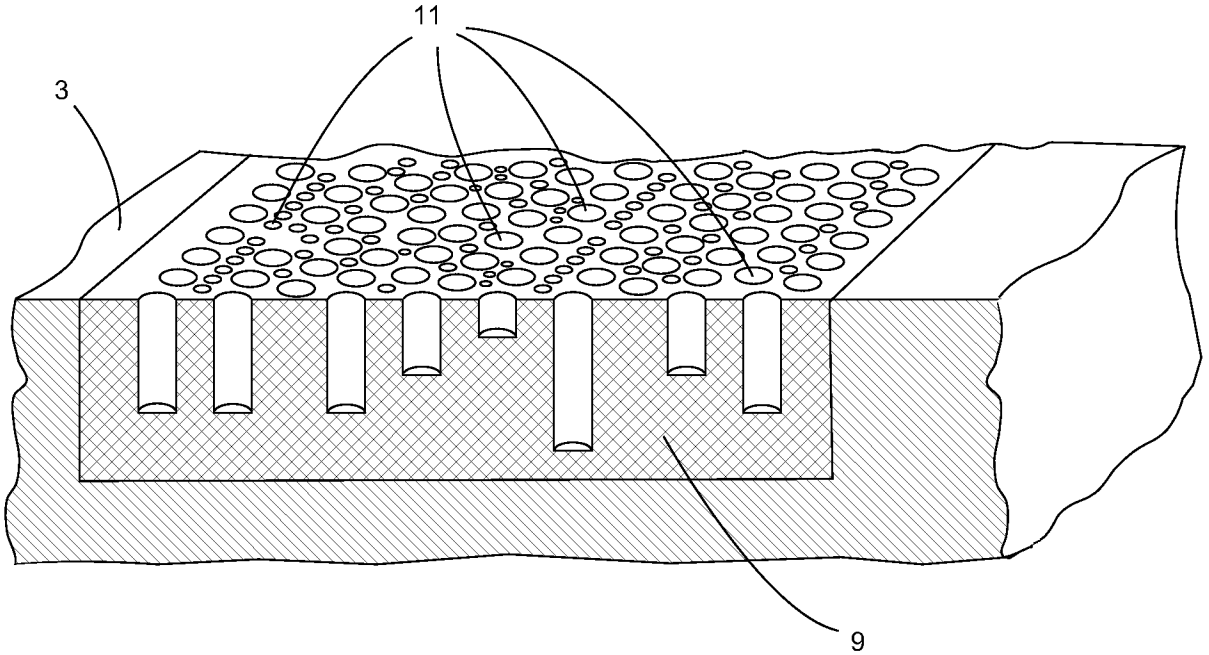
FIG. 5 shows a view corresponding to FIG. 2 of an embodiment with substantially cylindrical resonators.

FIG. 5 shows a variant in which the resonators, designated with 11, do not take a slot-like form, but each have roughly the form of a cylinder. These resonators 11 are also based on a ¼λ or ¾λ resonance with frequencies associated with the respective depths of resonators 11, the depths being chosen with a view to the sound waves to be deflected.

Figure 2:
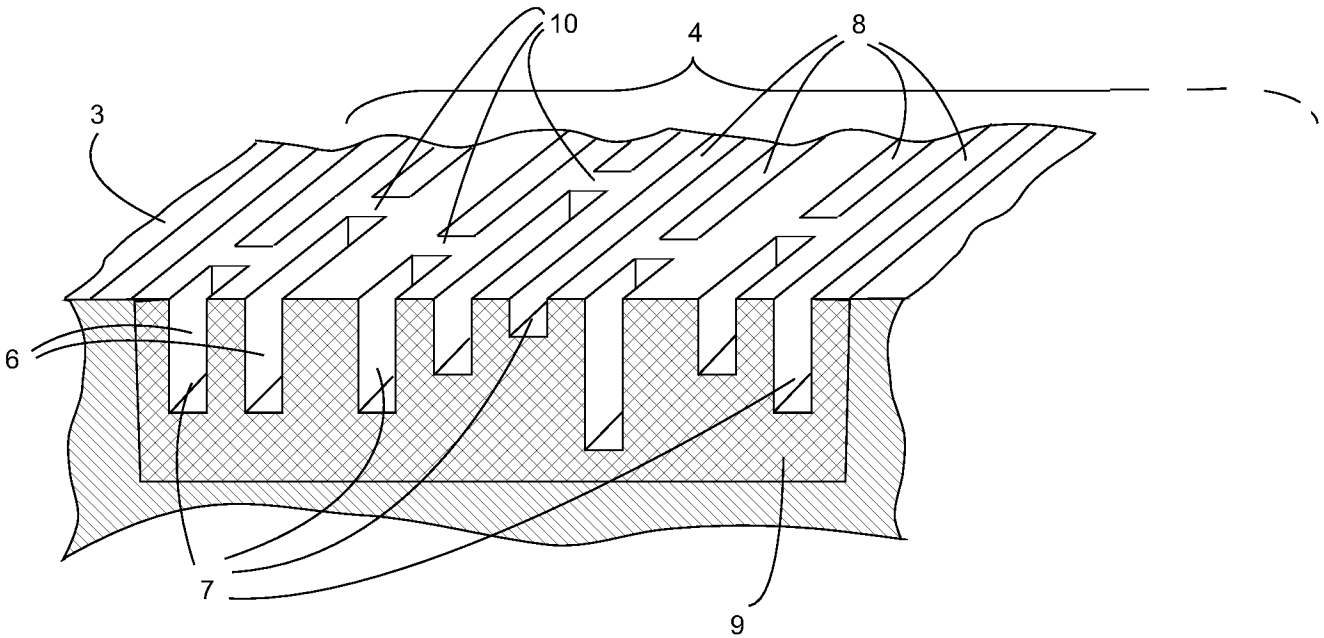
FIG. 2 shows the detail II of FIG. 1 on larger scale.
Figure 6:
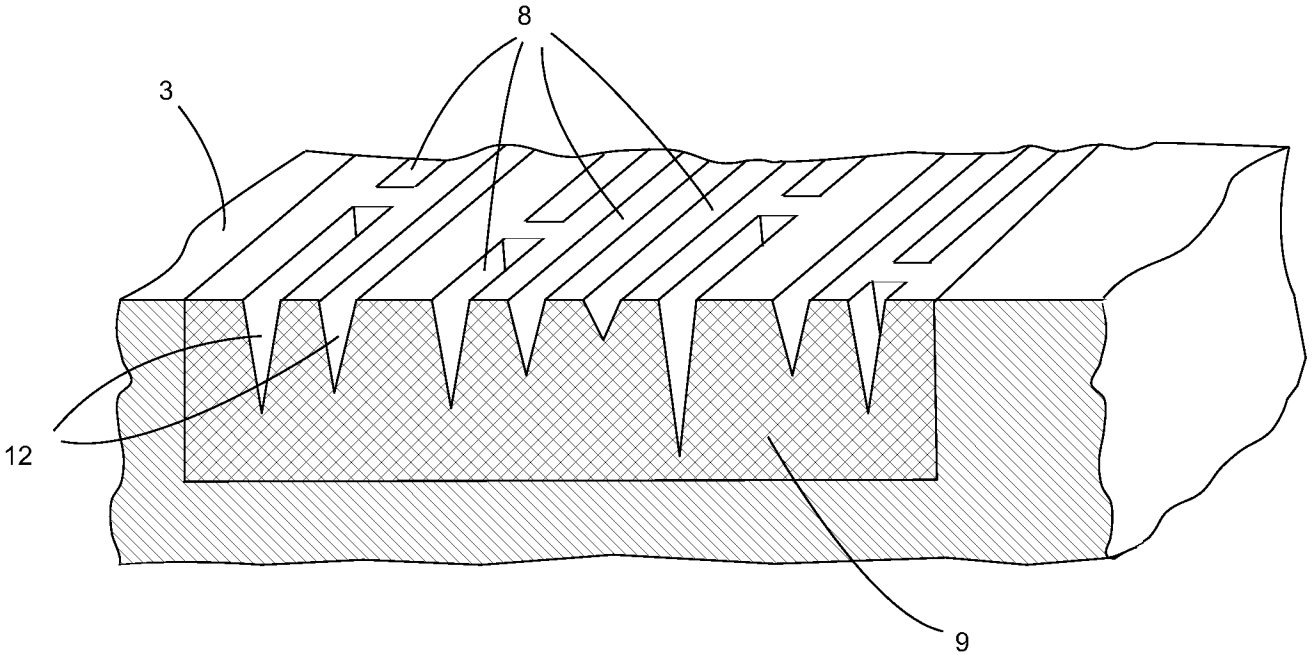
FIG. 6 shows a view corresponding to FIG. 2 of a variant in which the slot-like resonators have not a rectangular but a triangular cross-sectional form.

FIG. 6 shows an embodiment which, in contrast to the embodiment according to FIG. 2, comprises resonators 12 with a triangular cross-sectional form. Like resonators 6 according to FIG. 2, resonators 12 are embodied as elongate slots.

Figure 7:
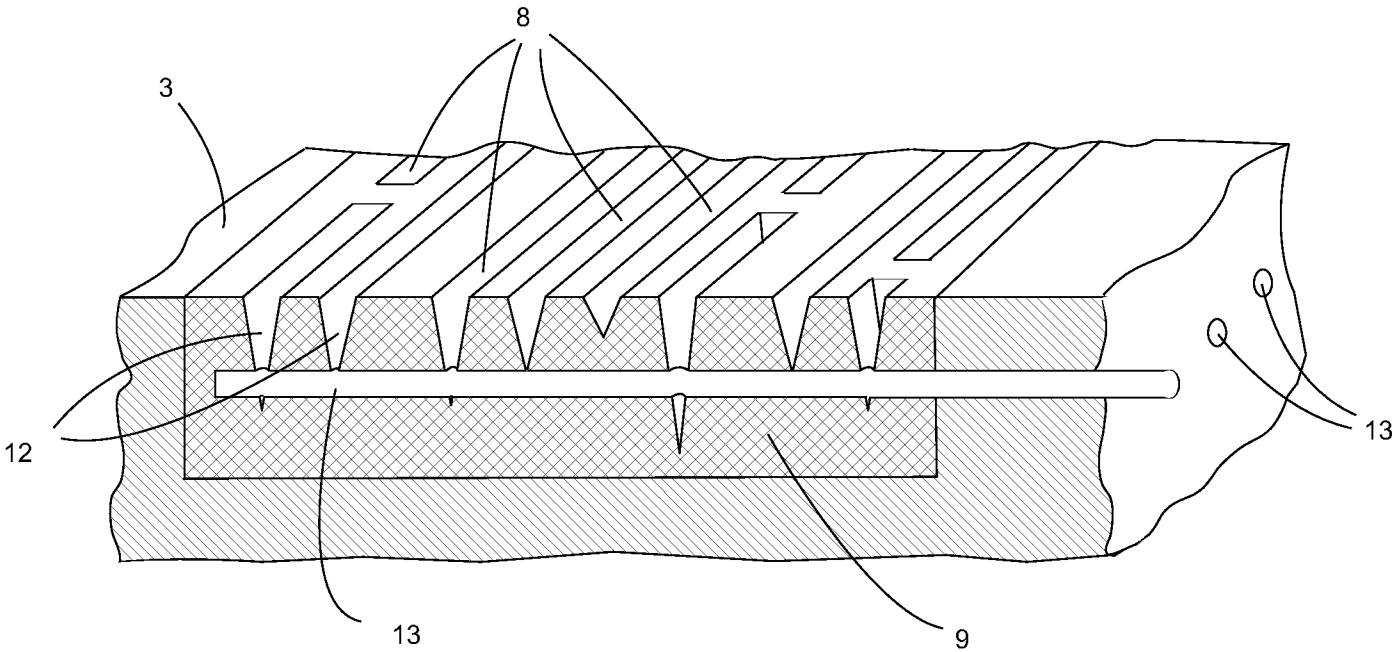
FIG. 7 shows a view corresponding to FIG. 6 of an embodiment in which the construction element with the resonators is provided with drainage pipes.

FIG. 7 shows an embodiment in which the concrete construction 9 is also provided with drainage pipes 13. These extend at a level such that they are in open connection with most of the resonators.

Alternatively, it is possible to envisage a variant in which downward directed drainage pipes extend on the lowest zones of the resonators. Particularly in the case where these have a form widening in downward direction, there is a very limited chance of blockage thereof by sand, dirt and the like.

Figure 8:
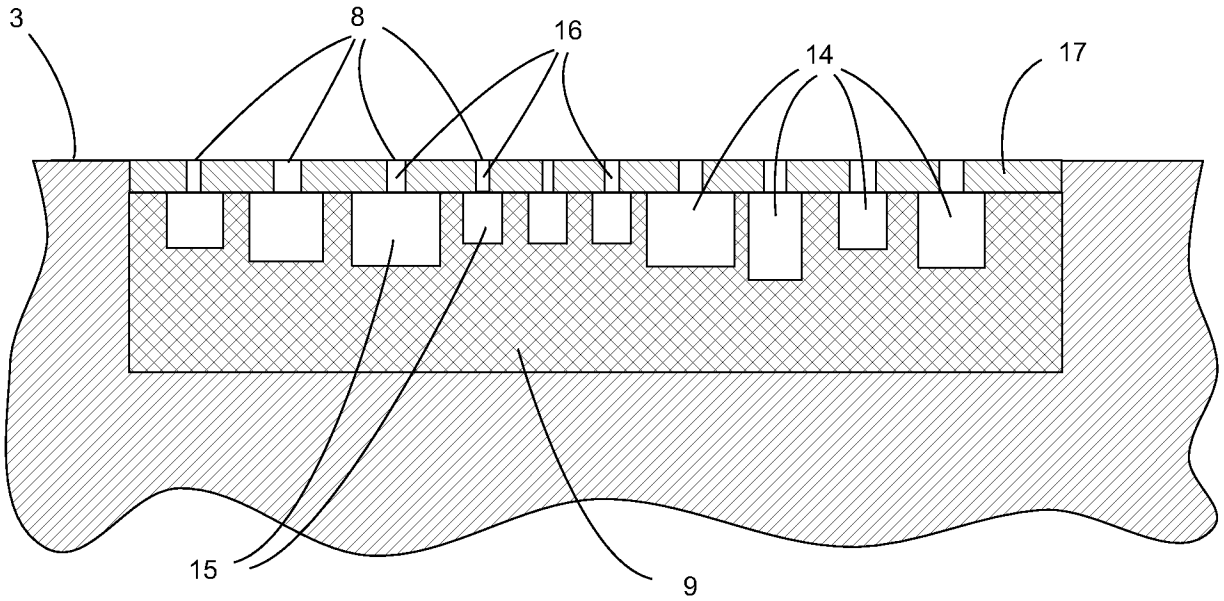
FIG. 8 shows a section corresponding to FIG. 3 of a variant in which the resonators are Helmholtz resonators.

In the embodiment according to FIG. 8 the resonators 14 are not based on a ¼λ or ¾λ resonance, but are embodied as Helmholtz resonators. For this purpose each of the resonators comprises a cavity 15 of a chosen volume, which cavity 15 is connected via a tube 16 of chosen diameter and length to the associated orifice 8. The resonance frequencies of resonators 14 can be chosen as required by suitable dimensioning.

As shown in FIG. 8, the concrete construction 9 comprises the cavities 15 embodied as blind holes and tubes 16 are embodied as through-holes in register with cavities 15. For this purpose the concrete construction 9 and cover slab 16 are correspondingly formed and means, which are not drawn but which are generally known per se, are used for correct registering of cover slab 17 on top of construction 19. Use can be made of a pattern of recesses and protrusions on construction 9 and cover slab 17 which fit therein.

Cover slab 17 can also be manufactured from concrete. Alternatively, use can also be made of an optionally reinforced plastic, such as glass fibre-reinforced polyester.

Attention is drawn to the fact that the constructions with the resonators must preferably be positioned in all embodiments as close as possible to side edge 18 of the associated traffic lane 3. This does after all realize the greatest possible attenuating effect.

Figure 9:
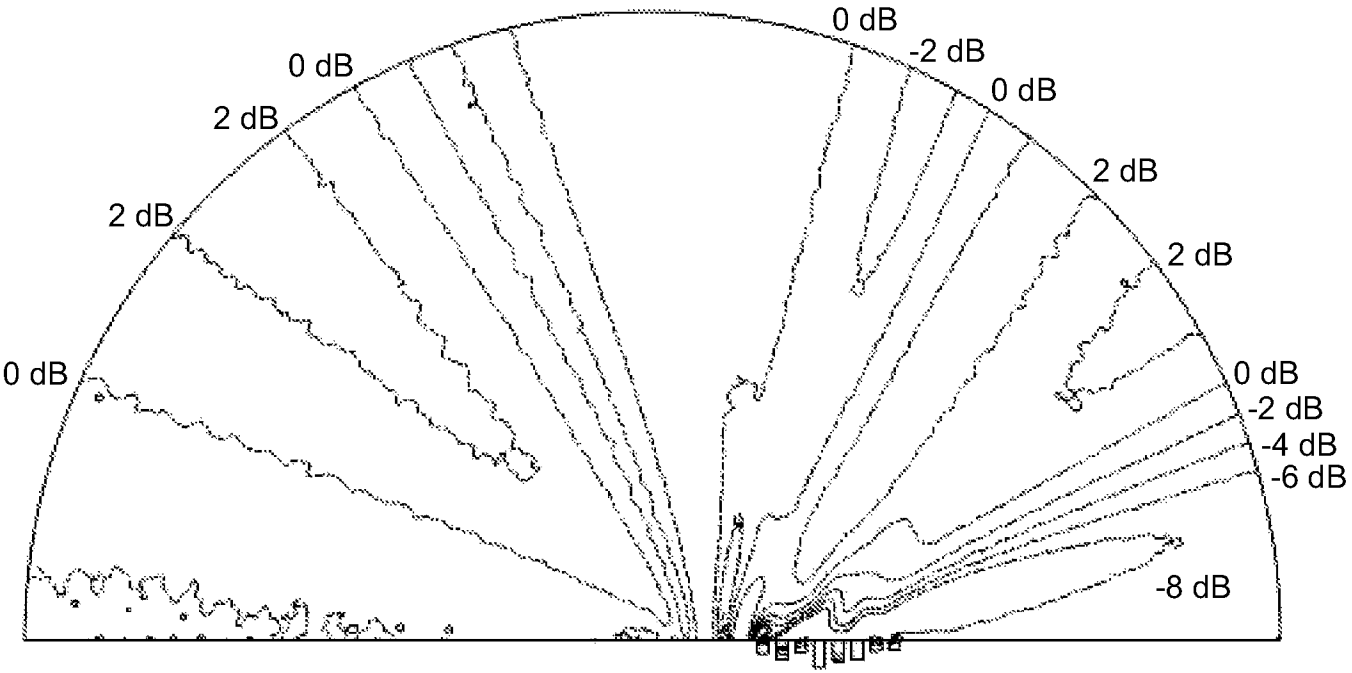
FIG. 9 shows the calculated deflection of a point source by a resonating element in the roadside shoulder at a determined frequency.

FIG. 9 shows the calculated deflection of a point source at a determined frequency of the sound by the resonating element in the shoulder as according to the invention. This graphic representation shows values of the sound level in dB SPL for a point source. This figure shows that sound emitted in lateral direction at an angle of 0° to about 20° is attenuated substantially.

In order to demonstrate the operation of the resonating diffractors according to the invention, several of the figures show what the final reduction in emitted acoustic power is when a resonator is applied, compared to the situation where no resonator is applied. It is noted that the reduction in the acoustic power is defined as the reduction in the acoustic power per meter through the part of the source-enveloping arc from 0° to 20°.

Figure 10:
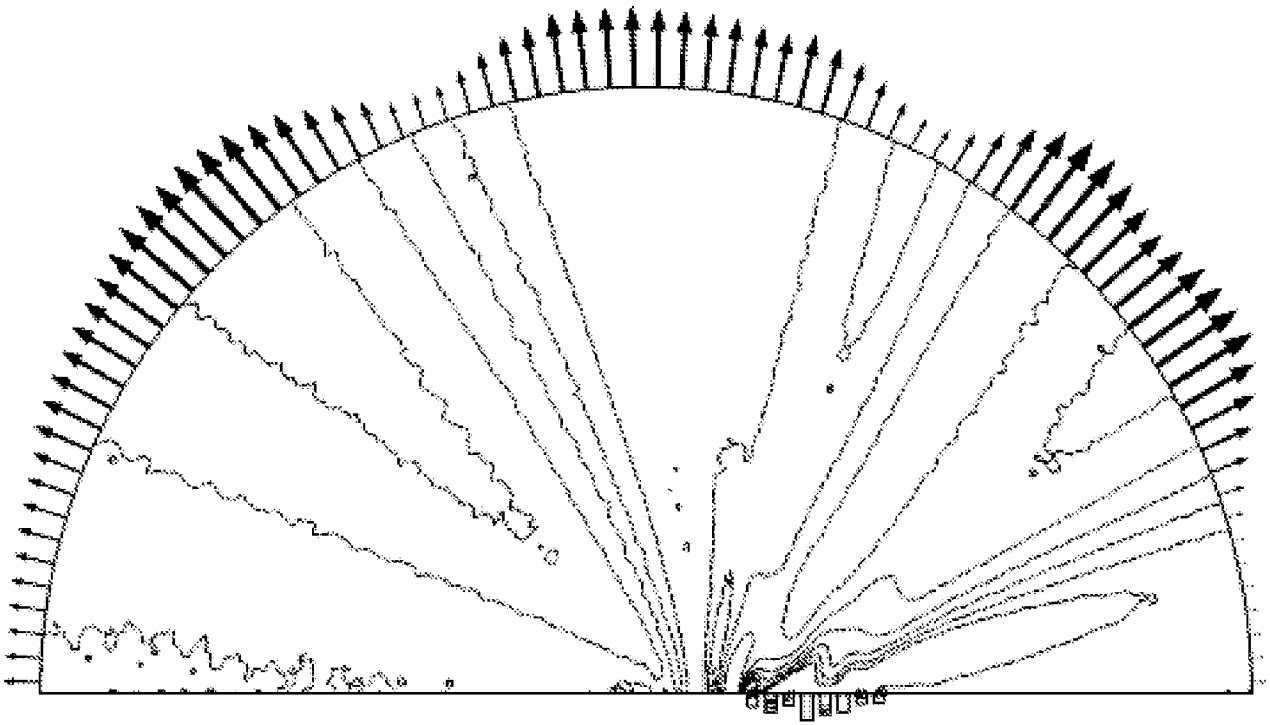
FIG. 10 shows a schematic representation of the intensity as a function of the elevation in the configuration according to FIG. 9.

FIG. 10 shows an illustration hereof corresponding to FIG. 9. The length of the arrows on the semicircle are illustrative of the acoustic intensity. It is noted that this figure may not be interpreted in exactly quantitative manner, but that it serves only by way of illustration. By now integrating the acoustic intensity in the range from 0° to 20°, the power per meter flowing through this sector is obtained. This is compared to the situation where no resonator is applied. In formula:

$$\text{attenuation} = -10 \log 10(P0°\text{-}20° \text{ with resonator}/P0°\text{-}20° \text{ without resonator}),$$

wherein P is defined as the power per meter flowing through the arc with a value of 20°.

Figure 11:
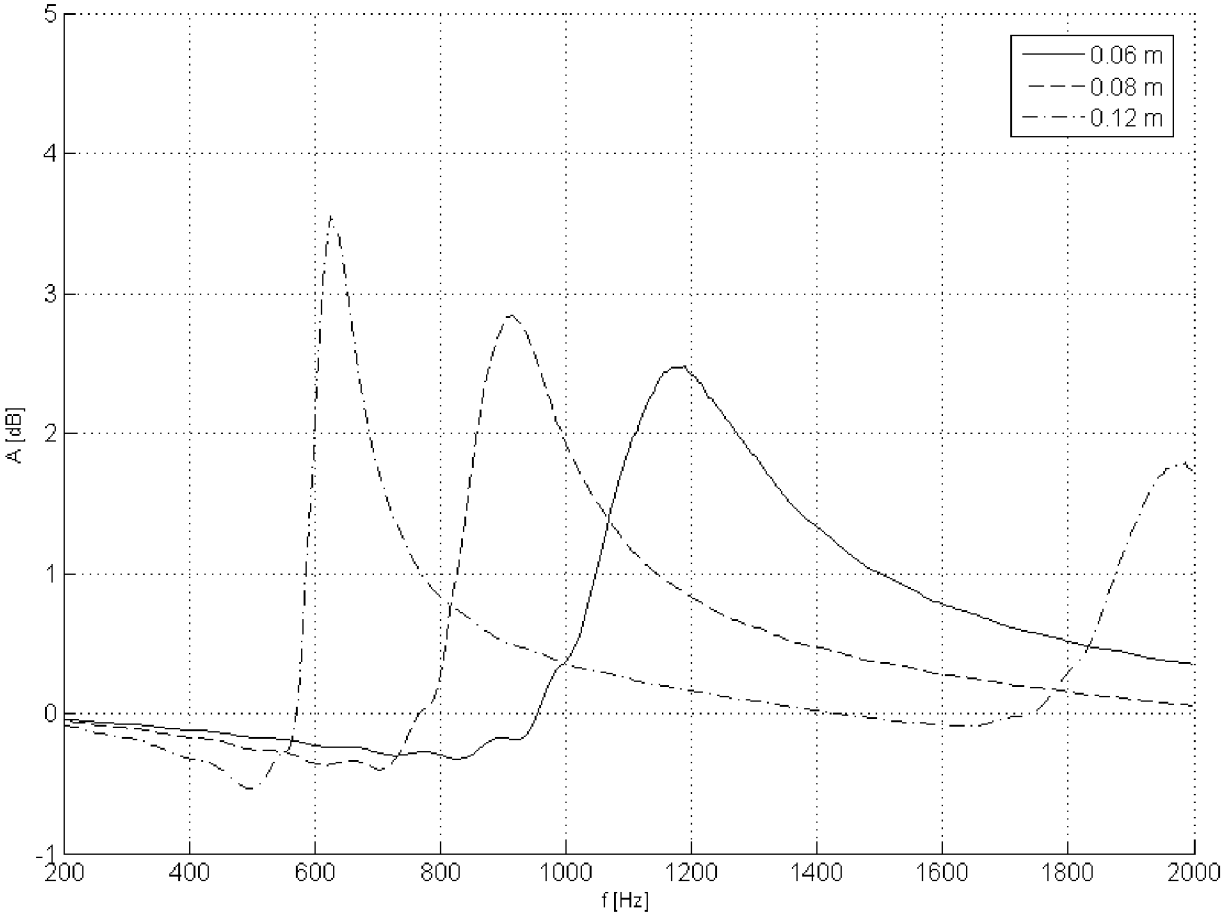
FIG. 11 shows the sound level reduction as a function of the frequency for different values of the depth of a single resonator.

FIG. 11 shows the sound level reduction as a function of the frequency for differing values of the depth of a single resonator. It will be apparent that the depth of the resonator determines the frequency at which the sound level reduction is at maximum.

Figure 12:
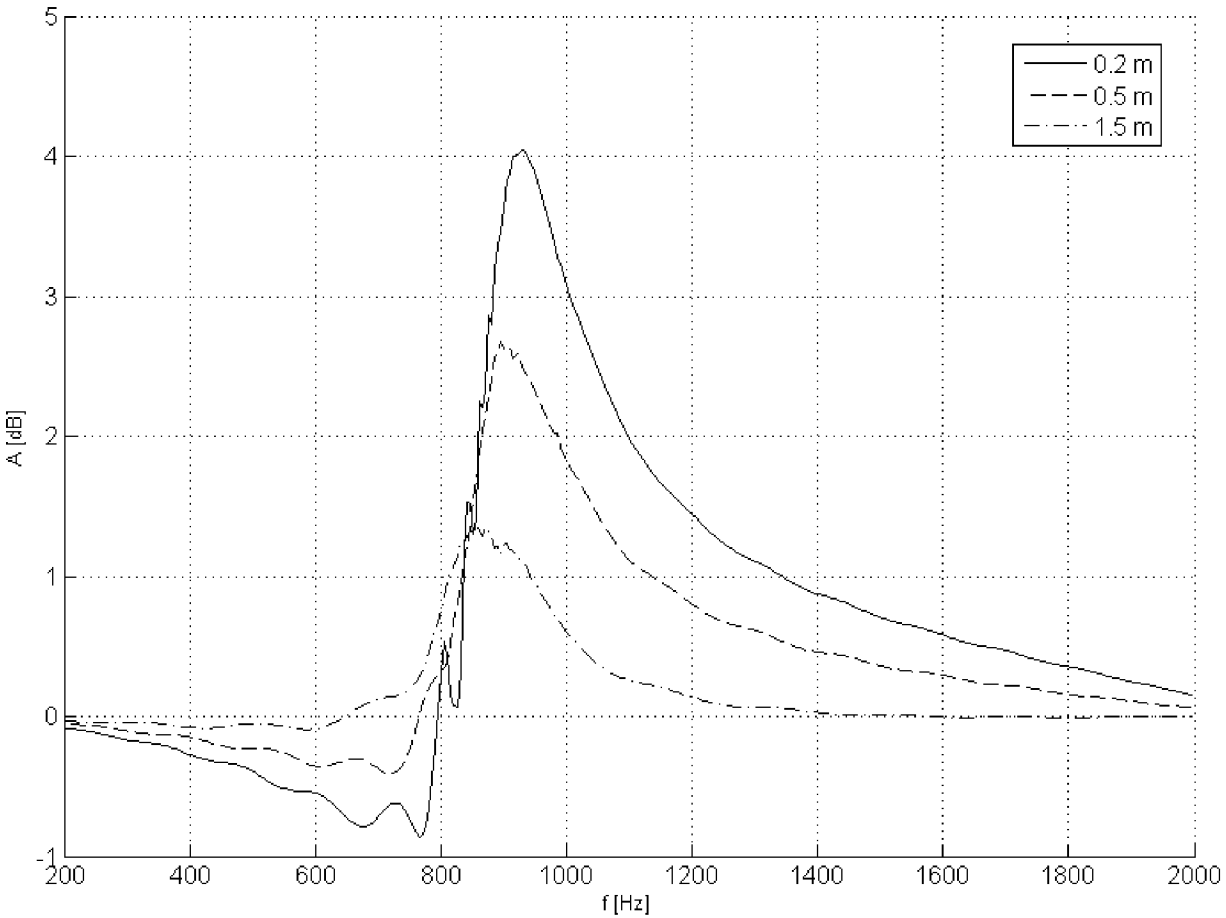
FIG. 12 shows the reduction in the sound level subject to the distance between the source and the resonator.

FIG. 12 shows the effect of the distance between the source and the resonator. The figure shows that a greater reduction is realized when the resonator is placed closer to the source. It will also be apparent that the sound level reduction, for this single resonator above 800 Hz, is substantially greater than the increase in the sound pressure level between 200 Hz and 800 Hz. When a plurality of resonators are used which are tuned to lower frequencies, this (low) amplification can be eliminated if desired.

Figure 13:
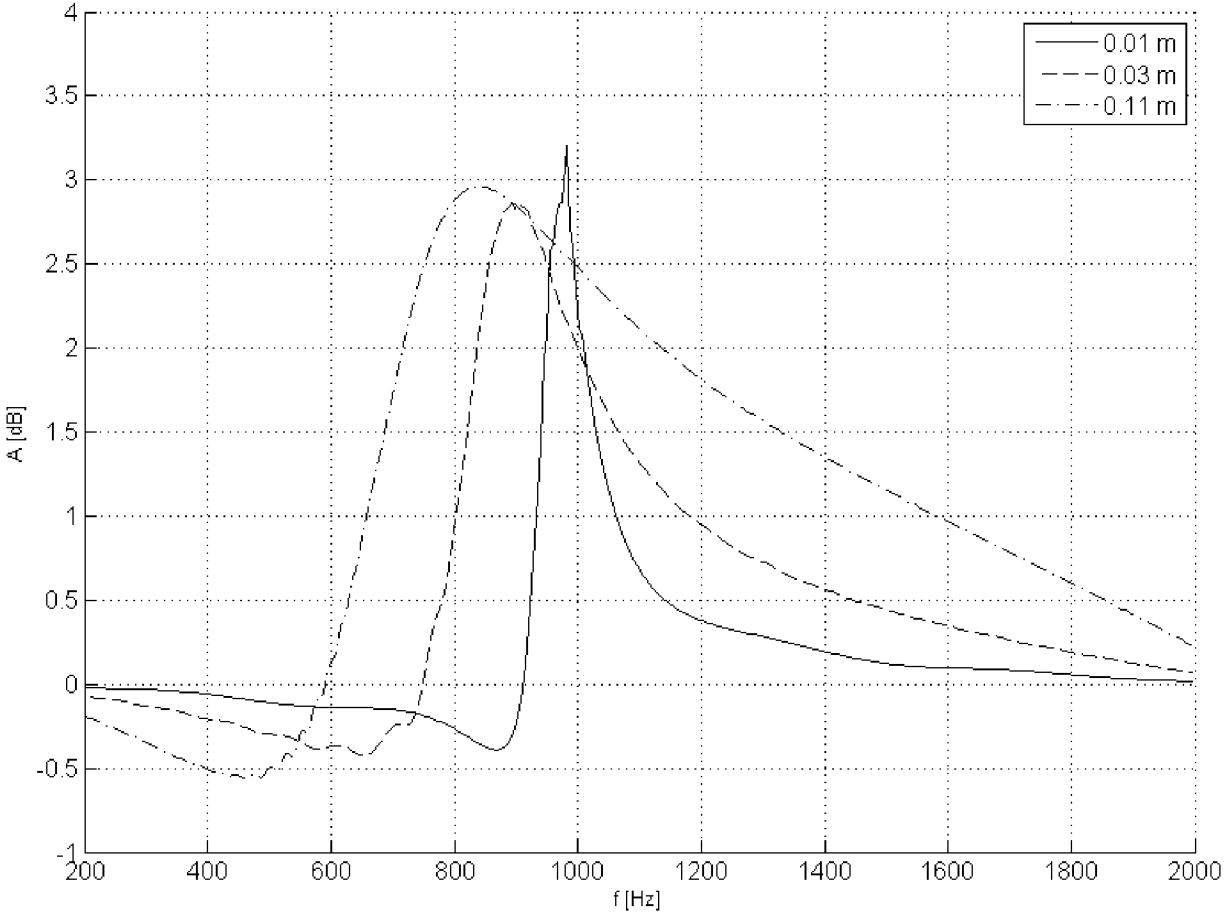
FIG. 13 shows the reduction in the sound level subject to the width of a single resonator.

Finally, FIG. 13 shows the effect of the width of a single resonator. The figure shows that a wider resonator causes a wider deflection.

What is claimed is:

1. A road with at least one traffic lane for motorized vehicular traffic, said road having attenuated lateral emission of sound caused by traffic travelling over the road, comprising, plurality of resonators arranged in a pattern distributed at least locally over a chosen length along the at least one traffic lane, wherein said resonators each comprise a resonance space placed under a surface adjacent to the at least one traffic lane, and debouching in an orifice situated at least roughly at a level of the surface of a roadside edge adjacent to the at least one traffic lane, wherein said resonators have resonance frequencies lying in a range that attenuate a sound produced by traffic travelling along the at least one traffic lane, and wherein said resonators are each embodied as a cavity having walls, the walls of which are acoustically substantially non-absorbing and which are free of acoustically absorbing material and absorbant material is not located in the cavity;

such that diffraction of said sound occurs in a direction differing from the lateral direction.

2. The road of claim 1, wherein the resonators are based on a depth resonance of ¼λ or ¾λ.

3. The road of claim 1, wherein each of the resonators further comprises a tube connecting the cavity to an orifice.

4. The road of claim 1, wherein the resonance frequencies lie in the range of about 500 Hz to 3 kHz.

5. The road of claim 1, wherein the resonators are configured as bins with upright side walls or a peripheral upright wall.

6. The road of claim 5 further comprising a construction wherein the bins form part of the construction.

7. The road of claim 5, further comprising a pattern of slot-like recesses which extend in longitudinal direction and optionally in mutually parallel zones and which each form a slot-like resonator, the slot-like resonator being bounded by two upright walls, wherein said upright walls are connected to each other locally by transverse partitions.

8. The road of claim 6, wherein the construction comprises a number of resonators.

9. The road of claim 7, wherein two or more resonators have mutually differing resonances.

10. The road of claim 1, wherein the resonators have an underside, and discharge openings for water and dirt connect to the underside.

11. The road of claim 1, wherein diffraction of said sound occurs in a direction differing from the lateral direction.

12. The road of claim 1, wherein the frequencies for attenuating a sound is about 1 kHz.

13. The road of claim 3, wherein each of the resonators are configured to perform as a Helmholtz resonator.

14. The road of claim 6, wherein the construction includes one or more components selected from the group consisting of optionally reinforced concrete, and optionally reinforced plastic.

15. The road of claim 14, wherein the construction includes reinforced plastic.

16. The road of claim 15, wherein the reinforced plastic is polyester reinforced with glass fiber.

17. The road of claim 14, wherein the construction includes reinforced concrete.

18. A road with at least one traffic lane for motorized vehicular traffic, to which road are added sound attenuating means which limit, at least for determined frequency ranges, the lateral emission of sound caused by traffic travelling over the road, a pattern of resonators placed in distributed manner is arranged at least locally over a chosen length along the traffic lane, which resonators each comprise a resonance space placed under the surface and debouching in an orifice situated at least roughly at a level of the surface of a roadside edge adjacent to the traffic lane, where the orifice has an overall orifice surface area, which resonators have resonance frequencies lying in the range of the frequencies of the sound for attenuating, in particular frequencies around about 1 kHz; and which resonators are each embodied as a cavity, wherein the walls of the cavity are acoustically substantially non-absorbing and free of acoustically absorbing material, such that diffraction of said sound occurs in a direction differing from the lateral direction.

19. The road of claim 18, wherein the resonators have a porosity defined as the overall orifice surface area divided by the overall surface area amounts to at least 10%.

20. The road of claim 18, wherein the resonators have a porosity defined as the overall orifice surface area divided by the overall surface area amounts to at least 50%.

* * * * *